US008738202B2

(12) United States Patent
Liberatore et al.

(10) Patent No.: US 8,738,202 B2
(45) Date of Patent: May 27, 2014

(54) METHOD AND APPARATUS FOR CONTROLLING SANDING ON LOCOMOTIVES

(75) Inventors: Aldo Liberatore, London (CA); Amarjit Soora, London (CA); Lucas Pul, Strathroy (CA)

(73) Assignee: ZTR Control Systems, London (CA)

( * ) Notice: Subject to any disclaimer, the term of this patent is extended or adjusted under 35 U.S.C. 154(b) by 146 days.

(21) Appl. No.: 13/300,236

(22) Filed: Nov. 18, 2011

(65) Prior Publication Data

US 2012/0158223 A1 Jun. 21, 2012

Related U.S. Application Data

(60) Provisional application No. 61/415,157, filed on Nov. 18, 2010.

(51) Int. Cl.
*G05D 1/00* (2006.01)
*B61C 15/10* (2006.01)

(52) U.S. Cl.
CPC ..... *B61C 15/107* (2013.01)
USPC ..... 701/19; 701/20

(58) Field of Classification Search
CPC ..... B61C 15/107
USPC ..... 701/19, 20
See application file for complete search history.

(56) References Cited

U.S. PATENT DOCUMENTS

| | | | | | |
|---|---|---|---|---|---|
| 1,951,553 | A * | 3/1934 | Martin | 291/3 |
| 2,162,423 | A * | 6/1939 | Davenport | 291/2 |
| 2,208,755 | A * | 7/1940 | Farmer | 291/15 |
| 2,232,752 | A * | 2/1941 | Wilson | 291/15 |
| 5,582,441 | A * | 12/1996 | Frost | 291/2 |
| 5,610,819 | A | 3/1997 | Mann et al. | |
| 5,615,119 | A * | 3/1997 | Vos | 701/4 |
| 6,104,148 | A | 8/2000 | Kumar et al. | |
| 6,194,850 | B1 | 2/2001 | Kumar et al. | |
| 6,587,764 | B2 * | 7/2003 | Nickles et al. | 701/19 |
| 6,893,058 | B2 | 5/2005 | Kumar et al. | |
| 2003/0020282 | A1 * | 1/2003 | Biddings | 291/2 |
| 2005/0024001 | A1 * | 2/2005 | Donnelly et al. | 318/66 |
| 2005/0140144 | A1 * | 6/2005 | Kumar | 291/2 |

* cited by examiner

*Primary Examiner* — Behrang Badii
*Assistant Examiner* — Daniel L Greene
(74) *Attorney, Agent, or Firm* — Brett J. Slaney; John R. S. Orange; Blake, Cassels & Grayden LLP

(57) ABSTRACT

To avoid a locomotive from travelling with a disabled sanding system, a method and system are provided for ensuring that the sanding system is not disabled if a primary speed reference used to detect the locomotive's speed is faulty. The method comprises determining a first speed measurement from a primary speed source; if the first speed measurement is below a setpoint, determining a second speed measurement from a secondary speed source; and if the second speed measurement is below the setpoint, disabling the automated and/or emergency initiated sanding control system on the locomotive.

24 Claims, 9 Drawing Sheets

METHOD AND APPARATUS FOR CONTROLLING SANDING ON LOCOMOTIVES

This application claims priority from U.S. Provisional Application No. 61/415,157 filed on Nov. 18, 2010, the contents of which are incorporated herein by reference.

TECHNICAL FIELD

The following relates to methods and apparatus for controlling sanding on locomotives.

BACKGROUND

Large traction vehicles such as locomotives are typically powered by electric traction motors coupled to axles of the vehicle. For example, a locomotive commonly has at least four sets of axles, typically six, and corresponding wheels per vehicle, with each set being connected via appropriate gearing to the drive shaft of an electric motor, referred to in the art as a traction motor. Traction motors, when operable, are supplied with electric current from a controlled source of power, commonly a traction alternator driven by the locomotive's engine. The traction motors apply torque to the locomotive's wheels, which in turn exert tractive effort on the rails on which the locomotive is travelling.

Locomotives are normally expected to produce high tractive efforts. Good adhesion between each wheel and the surface of the rail contributes to the efficient operation of the locomotive. The ability to produce high tractive efforts depends on the available or achievable adhesion between the wheel and rail. Certain rail conditions such as being wet or covered in ice/snow may require the application of a friction enhancing agent such as sand to be applied to the rails to improve the adhesion of the wheel to the rail. To achieve this, locomotives are equipped with sand boxes on either end of the unit and nozzles to dispense the sand to the rail on either side of the unit.

Locomotives may improve adhesion by initiating a flow of sand from the sand boxes to the rail surface. The flow of sand may be initiated in response to certain conditions being met, such as one or more wheel axles slipping. When one or more of these conditions is/are met, typical sanding systems will activate a flow of sand through sand applicators located at the appropriate wheels based on the direction of travel. Sand is normally dispensed at a fixed rate each time there is a demand for sanding from the locomotive control system. Sanding may also be applied manually by the operator. Manual application of sand may be used whenever the operator feels that it will assist in the performance of the locomotive.

An emergency sanding switch (ESS) may be activated whenever the locomotive's pneumatic brakes are placed into a penalty or emergency status. Both situations are used when a fast train stop is requested by the operator. As a safety requirement, all trains, once properly connected, in the correct sequence, and thus ready to move (i.e. "made up"), undergo complete testing of the brake systems to ensure that all brake cylinders on the whole train are functional. Some of the tests include placing the brake system into penalty application as well as emergency, both cases resulting in the ESS being activated.

In both cases, with the locomotive being at a standstill, a significant amount of sand is wasted, which is both costly and without real benefit, since the sand is not needed when the locomotive is not moving. Moreover, the sand that is dispensed during such testing may foul up the tracks and thus when the locomotive begins to move again, the attached cars would ride over the sand, which adds unnecessary wear to the train's components and drag to the pulling locomotives.

SUMMARY

In one aspect, there is provided a method for controlling a locomotive, the method comprising: determining a first speed measurement from a primary speed source; if the first speed measurement is below a setpoint, determining a second speed measurement from a secondary speed source; and if the second speed measurement is below the setpoint, preventing the activation of sanding on the locomotive due to triggering of an emergency sanding switch.

In another aspect, there is provided a computer readable medium comprising computer executable instructions for controlling a locomotive, the computer executable instructions comprising instructions for: determining a first speed measurement from a primary speed source; if the first speed measurement is below a setpoint, determining a second speed measurement from a secondary speed source; and if the second speed measurement is below the setpoint, preventing the activation of sanding on the locomotive due to triggering of an emergency sanding switch.

In yet another aspect, there is provided a locomotive control system for controlling a locomotive, the system comprising: a processor and memory, the memory storing computer executable instructions that when executed by the processor operate the locomotive control system by: determining a first speed measurement from a primary speed source; if the first speed measurement is below a setpoint, determining a second speed measurement from a secondary speed source; and if the second speed measurement is below the setpoint, preventing the activation of sanding on the locomotive due to triggering of an emergency sanding switch.

BRIEF DESCRIPTION OF THE DRAWINGS

Embodiments will now be described by way of example only with reference to the appended drawings wherein.

DETAILED DESCRIPTION OF THE DRAWINGS

Locomotive control systems may include logic for limiting the use of sand to avoid overuse and waste. For example, sanding control may be disabled while the locomotive is not moving, or is moving at a particularly low speed (e.g. 1 mph), which is often detected by measuring the locomotive's speed via an axle generator. In such cases, when the detected speed is less than a particular setpoint, such as 1 mph, the sanding system may be disabled. The disablement of the sanding system is normally applied to automatic sanding systems (i.e. a sanding system operated by a control system), but can also be applied to emergency, manual sanding circuits.

It has been recognized that if the axle generator, which is relied upon to control an interlock on the sanding system, fails, the above-noted logic would prevent sanding under any conditions. Regulatory bodies such as the Federal Railroad Administration (FRA) in the United States are known to have rules against operating locomotives with inoperable sanders. Therefore, if an axle generator fails, which in turn disables the sanders, to comply with this rule, the locomotive would need to be taken out of service until it is repaired. This can be extremely disruptive and costly, especially when taken out of service while in active use.

It has been found that to overcome the above-noted problems, a secondary measurement of locomotive speed can be used as a back-up, in the event that the primary indicator of locomotive speed fails. In this way, if the primary indicator of speed such as an axle generator fails, but the locomotive is still operational, continued operation of the sanding system can be ensured. The secondary measurement of locomotive speed is advantageously obtained by monitoring a global positioning system (GPS) receiver or the traction motor's volts and current, and such a measurement can be acquired on an ongoing basis or triggered upon detecting that the primary measurement (e.g. via the axle generator) is below the predetermined set point or otherwise will instruct the sanding system to shut down. By sensing a situation where the primary speed source such as an axle generator indicates a speed of zero or below the threshold (e.g. 1 mph) while simultaneous monitoring of a secondary speed source such as the voltage and current of the traction motors indicates a higher speed, an error message can be generated for diagnostic purposes and operation of the sanding system can be enabled, i.e. with an active ESS signal. This avoids disablement of the sanding system when it should be active.

Figure 1:
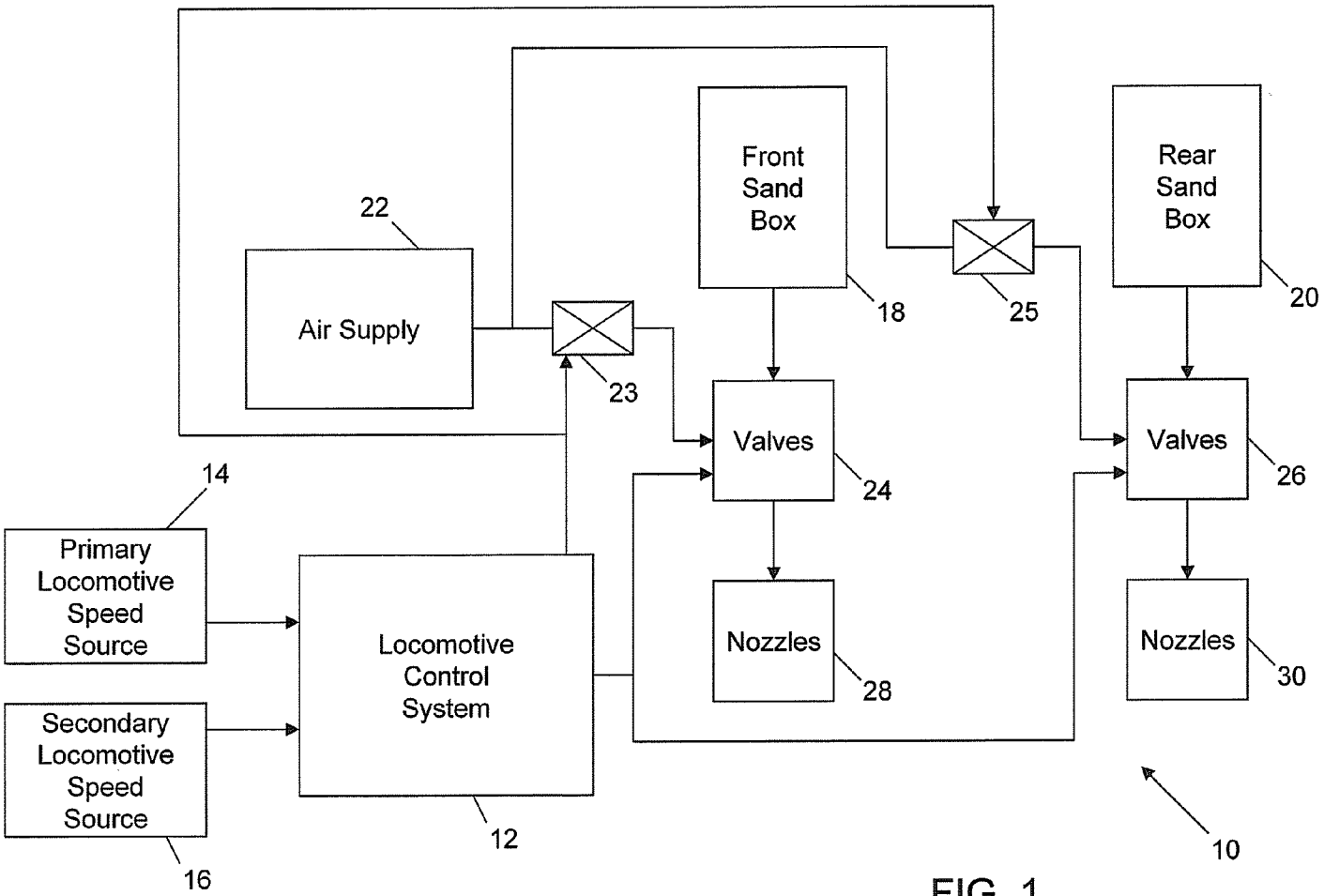
FIG. 1 is a block diagram of a sanding system controlled by a locomotive control system.

Turning now to FIG. 1, an example schematic diagram is shown of a sanding system 10 controlled by a locomotive control system 12. As noted above, the sanding system 10 is used for limiting the application of sand to railroad rails. It can be appreciated that the sanding system 10 shown in FIG. 1 may be operable in both automatic and manual modes and the configuration shown is for illustrative purposes only.

The sanding system 10 in this example comprises a front sand box 18 and a rear sand box 20 which are used to store the sand. The sand boxes 18, 20 feed sand to respective sets of nozzles 28, 30 via respective sand valves 24, 26. In typical arrangements, a locomotive with two trucks would include left and right nozzles for each of the front and rear of each truck for a total of eight nozzles. Alternative embodiments may include more or fewer than eight total nozzles 28, 30, including other nozzles (not shown) on other locomotives in a consist.

A compressed air supply 22 is typically used to supply compressed air to respective air valves 23, 25, which are controlled by the locomotive control system 12 to in turn provide air to the electrically controlled sand valves 24, 26. As can be seen, the sand values 24, 26 are also controlled by the locomotive control system 12 to utilize the air from the air supply 22 to feed sand from the sand boxes 18, 20 to the nozzles 28, 30 for applying the sand to the rails.

As discussed above, the locomotive control system 12 can be operable to disable the sanding system 10 upon detecting that the locomotive is moving at a measured speed that is less than a setpoint, e.g. when stopped. Such speed measurements may be obtained from a primary locomotive speed source (hereinafter "primary speed source") 14. The primary speed source 14 may comprise, for example, an axle generator which provides an indication of speed based on the rotation of a locomotive axle. To address problems that may arise when the primary speed source 14 fails (e.g. a sensor or other component gives a false reading or no reading at all), a secondary locomotive speed source (hereinafter "secondary speed source") 16 is referenced by the locomotive control system 12 to obtain a secondary speed measurement. One example secondary speed source 16 may comprise GPS readings that are indicative of the speed of the locomotive 10. Another example secondary speed source 16 may comprise volt and current measurements from the traction motors of the locomotive as will be explained in greater detail below. By checking the secondary speed source 16 when the primary speed source 14 indicates that the sanding system 10 should be disabled, the locomotive control system 12 can detect whether there is a problem or failure associated with the primary speed source 14 and thus avoid unnecessarily shutting down the sanding system 10. In this way, the costly and time consuming process of taking a locomotive out of service can be avoided as another reliable source of speed information can be utilized in the meantime.

Figure 2:
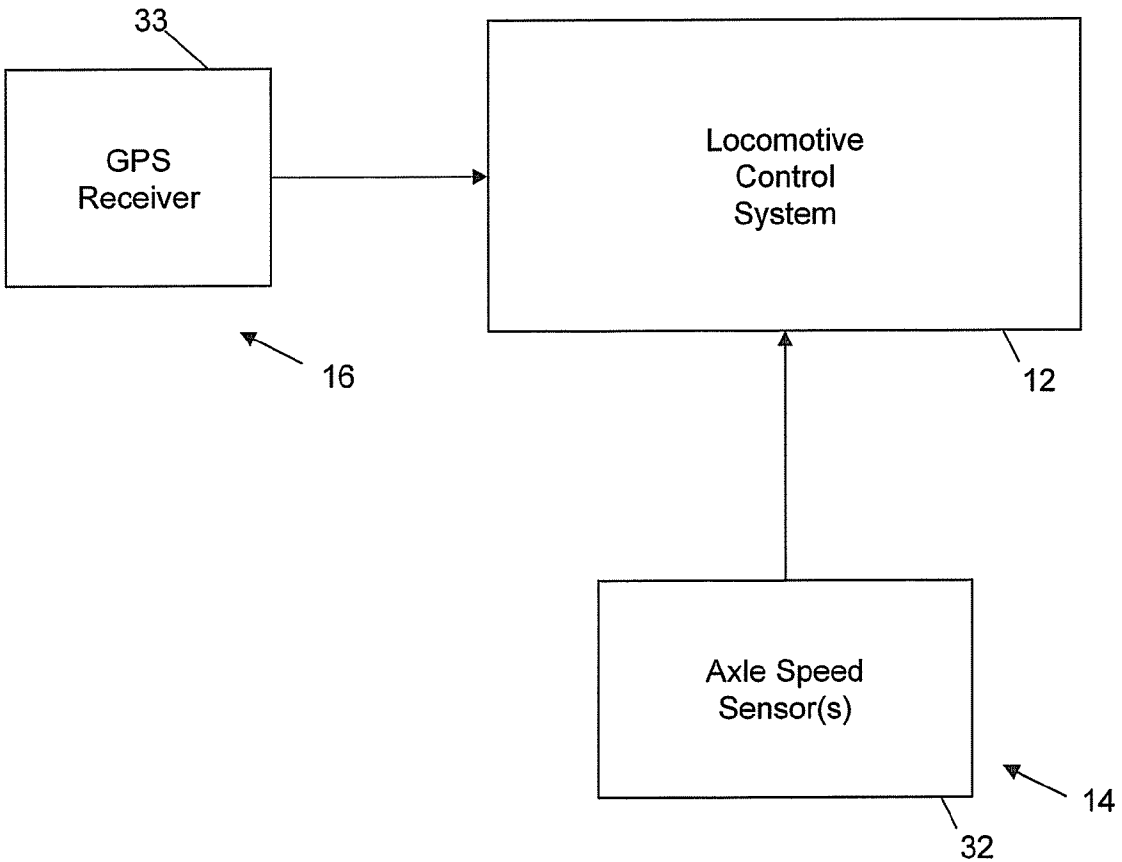
FIG. 2 is a block diagram of a locomotive control system configured to obtain primary and secondary speed measurements from axle speed sensors and a global positioning system (GPS) receiver respectively.

FIG. 2 illustrates an example wherein the primary speed source 14 comprises one or more axle speed sensors 32, and the secondary speed source 16 comprises information obtained from a GPS receiver 33.

Figure 3:
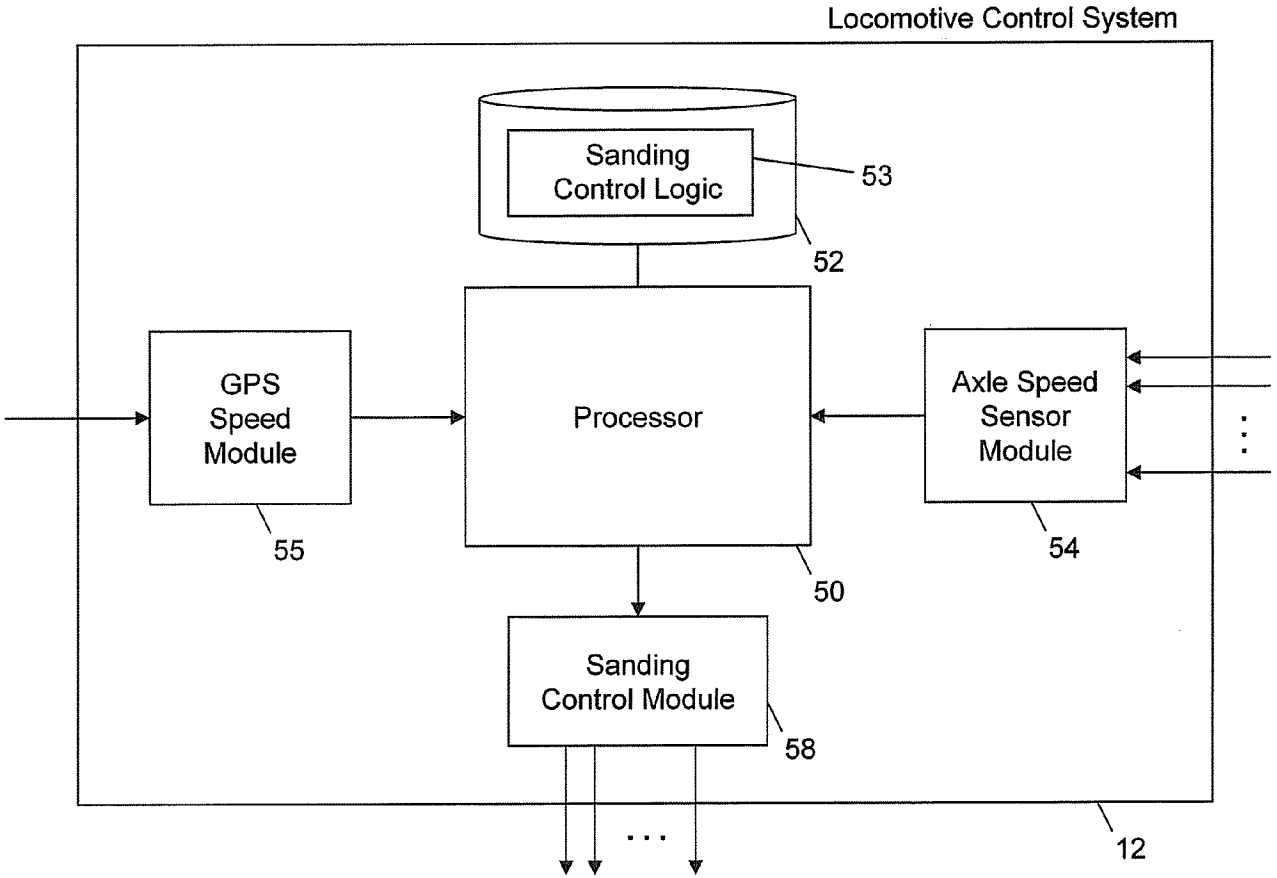
FIG. 3 is a block diagram showing details of an example configuration for the locomotive control system of FIG. 2.

Turning now to FIG. 3, an example configuration for the locomotive control system 12 is shown, which enables both the primary and secondary speed sources 14, 16 to be utilized thereby. It can be appreciated that the locomotive control system 12 may have various other components, modules, logic, etc., which are not shown in FIG. 3 for ease of illustration. For example, the locomotive control system 12 may have logic and components for detecting and correcting wheel slip, performing diagnostic checks, controlling dynamic braking, etc. to name a few. In the example configuration shown in FIG. 3, the locomotive control system 12 has or otherwise utilizes a processor 50 and has or has access to memory 52, which in this example comprises sanding control logic 53 used for controlling the sanding system 10. A portion of the sanding control logic 53 will be described below and it will be appreciated that other logic is typically utilized, e.g. for controlling the operation of the valves 23, 24, 25, 26 for normal use.

In this example, the processor 50 applies or executes the sanding control logic 53 to provide instructions to the sanding system 10 via a sanding control module 58 (this could be as simple as an interlocking relay). For example, if the processor 50 detects that both the primary and secondary speed measurements are below the speed setpoint for disablement, the processor 50 then instructs the sanding control module 58 to shut down or otherwise disable the sanding system 10. The processor 50 obtains the primary speed measurement from the primary speed source 14 by obtaining a reading from an axle speed sensor module 54. The axle speed sensor module 54 obtains a signal from one or more axle sensors 32 and converts or otherwise interprets a speed measurement from these signals. The processor 50 obtains the secondary speed measurement from the secondary speed source 16 in this example by obtaining a speed measurement provided by a GPS speed module 55, which obtains a speed reading from the GPS receiver 33.

Figure 4:
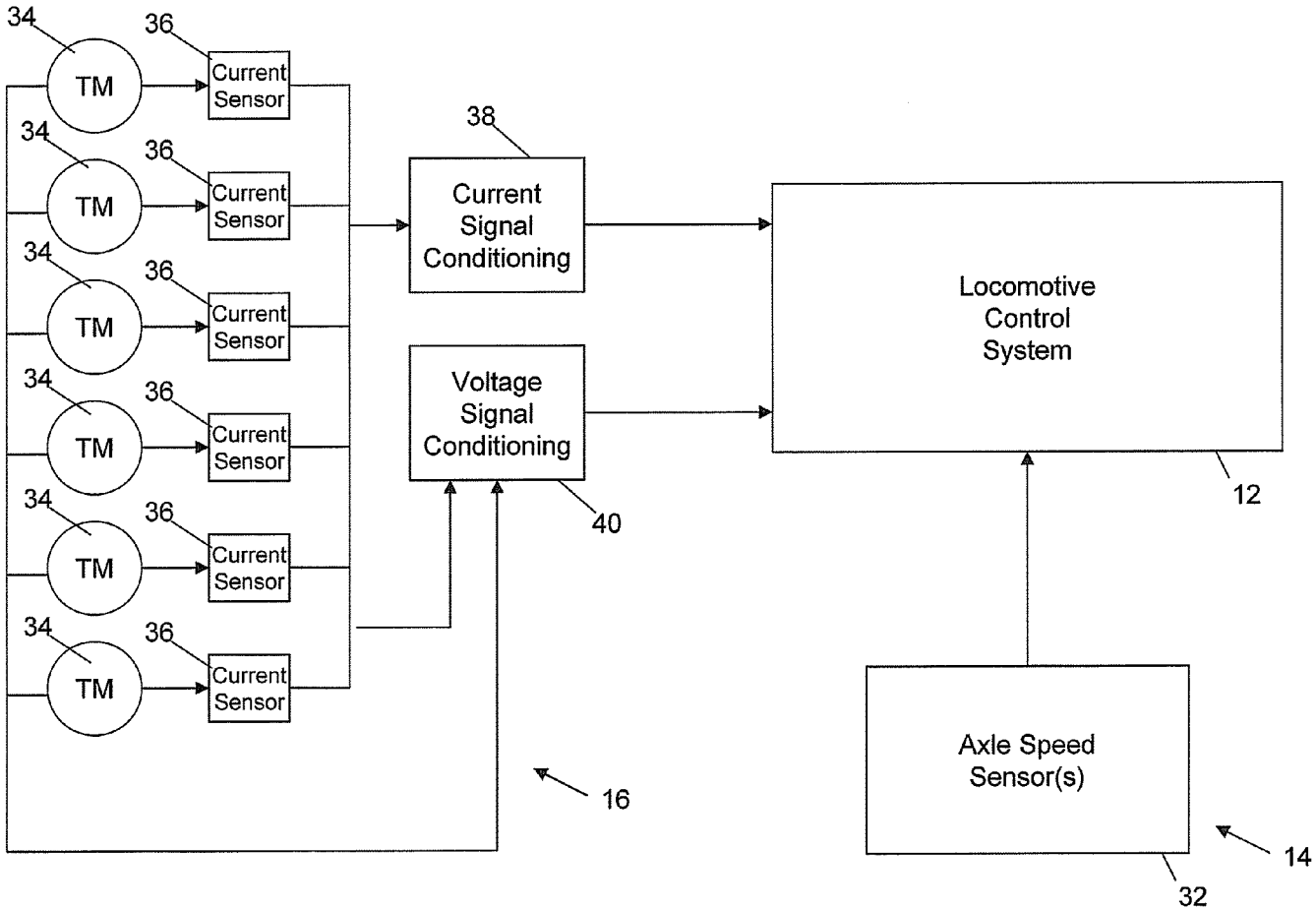
FIG. 4 is a block diagram of a locomotive control system configured to obtain primary and secondary speed measurements from axle speed sensors and traction motor voltage and current readings respectively.

FIG. 4 illustrates an example wherein the primary speed source 14 comprises one or more axle speed sensors 32 as described above, and the secondary speed source 16 comprises information associated with the traction motors (TM) 34 of the locomotive. In the example shown, six (6) traction motors are present, however, it can be appreciated that the principles apply to other arrangements comprising more or fewer traction motors 34. In this example, a current sensor 36 is coupled to each traction motor 34. The current sensors 36 take current readings indicative of the current flowing through their corresponding traction motors 34 and provide these readings to current signal conditioning circuitry 38, which is used to condition the signals for use by the locomotive control system 12, e.g. using typically signal processing and conditioning techniques. At the same time, voltage readings indicative of the voltage across the traction motors 34 can be taken and conditioned by voltage signal conditioning circuitry 40.

The current signal conditioning circuitry 38 and voltage conditioning circuitry 40 thus provide current and voltage measurements or readings to the locomotive control system 12, which the locomotive control system 12 can use to compute an estimate of locomotive ground speed.

Figure 5:
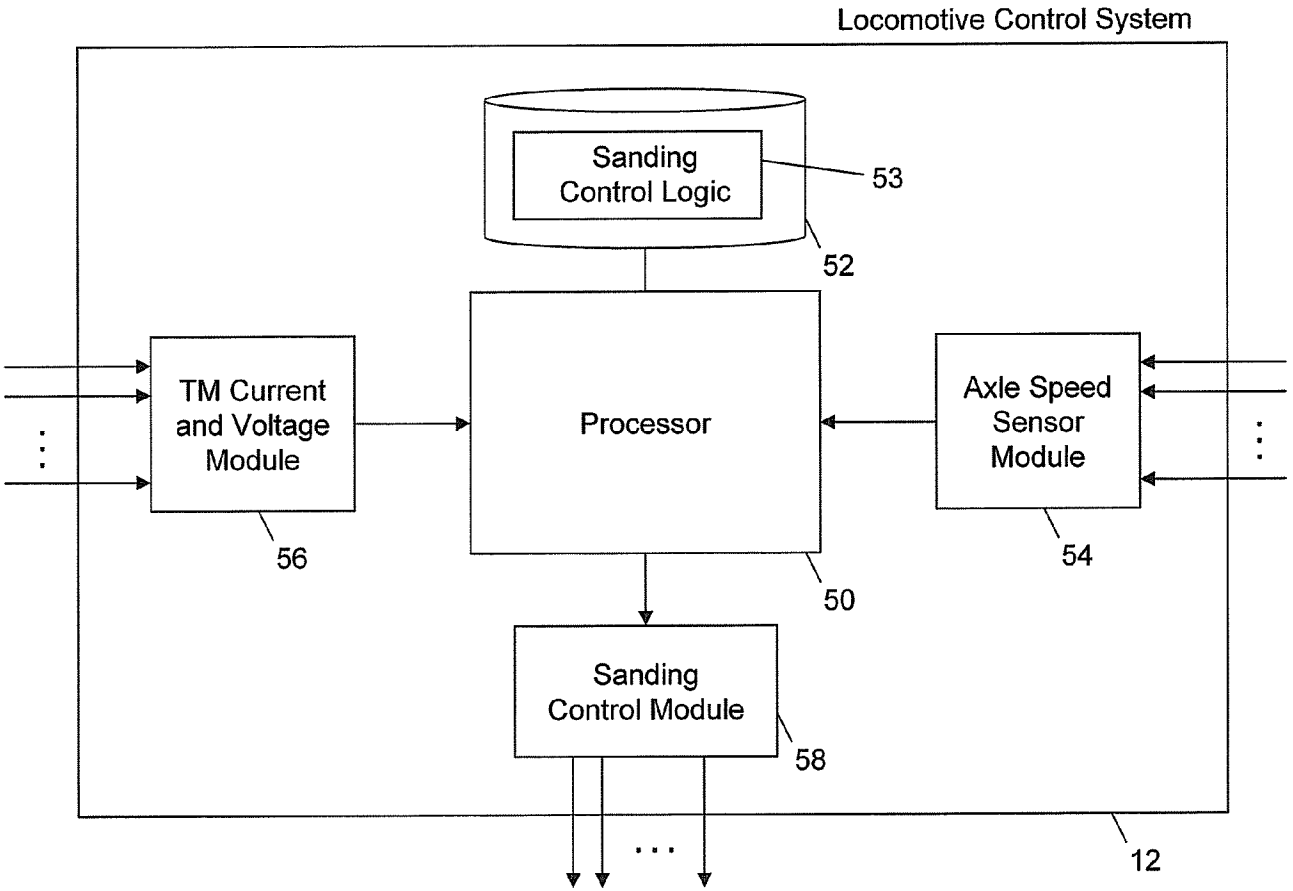
FIG. 5 is a block diagram showing details of an example configuration for the locomotive control system of FIG. 4.

Turning now to FIG. 5, an example configuration for the locomotive control system 12 is shown, which enables both the primary and secondary speed sources 14, 16 to be utilized thereby, wherein the second speed source 16 is obtained using, for example, the configuration shown in FIG. 4. It can be appreciated that the locomotive control system 12 may have various other components, modules, logic, etc., which are not shown in FIG. 5 for ease of illustration. For example, the locomotive control system 12 may have logic and components for detecting and correcting wheel slip, performing diagnostic checks, controlling dynamic braking, etc. to name a few. In the example configuration shown in FIG. 5, the locomotive control system 12 has or otherwise utilizes a processor 50 and has or has access to memory 52, which in this example comprises sanding control logic 53 used for controlling the sanding system 10. A portion of the sanding control logic 53 will be described below and it will be appreciated that other logic is typically utilized, e.g. for controlling the operation of the valves 24, 26 for normal use.

In this example, the processor 50 applies or executes the sanding control logic 53 to provide instructions to the sanding system 10 via a sanding control module 58 (this could be as simple as an interlocking relay). For example, if the processor 50 detects that both the primary and secondary speed measurements are below the speed setpoint for disablement, the processor 50 then instructs the sanding control module 58 to shut down or otherwise disable the sanding system 10. The processor 50 obtains the primary speed measurement from the primary speed source 14 by obtaining a reading from an axle speed sensor module 54. The axle speed sensor module 54 obtains a signal from one or more axle sensors 32 and converts or otherwise interprets a speed measurement from these signals. The processor 50 obtains the secondary speed measurement from the secondary speed source 16 in this example by obtaining a speed measurement provided by a TM current and voltage module 56. The TM current and voltage module 56 obtains one or more voltage and one or more current readings and computes the secondary speed measurement therefrom.

One example for calculating the secondary speed measurement using current and voltage readings will now be provided for illustrative purposes only. Typically, speed can be calculated through understanding the characteristics of the traction motor 34 in question. For example, the chart shown in FIG. 6 may be used to characterize the volts, current, and speed of one of the most popular traction motors in operation in North America. The assumption is that the field current is the same as the armature current. It can be appreciated that other charts may exist that can relate to different field weakening strategies. Besides the traction motor armature volts and current, there are two other locomotive characteristics that are identified:

The first characteristic is gear ratio, e.g. 15:62 (i.e. for every 62 turns of the traction motor armature, the wheels rotate 15 times).

The second characteristic is wheel diameter, e.g. 40" (this varies with locomotive model and with wheel wear). Often a nominal number such as 39" is used with satisfactory results.

Figure 6:
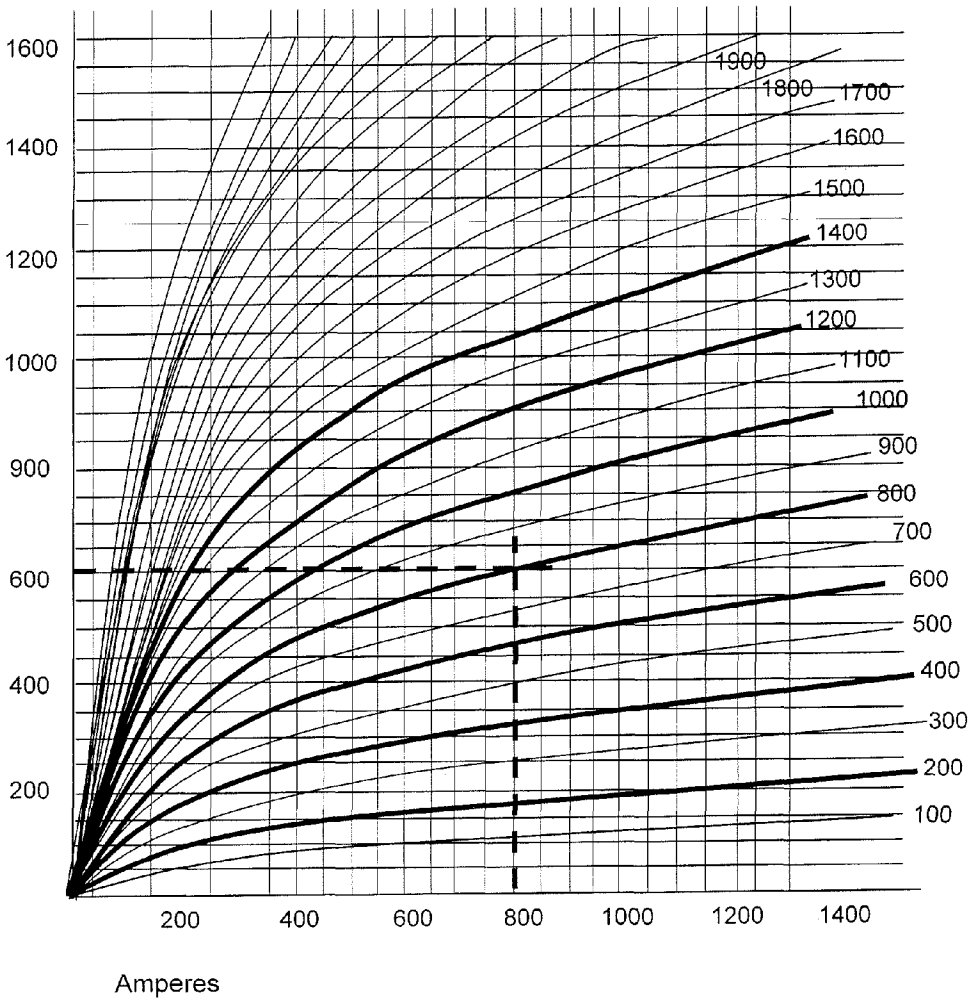
FIG. 6 is a chart showing current versus volts characteristic for a typical traction motor.

With the chart of FIG. 6 accessible to the microprocessor, either through a look up table or, if available, using a characterization formula that defines the traction motor's characteristics, the armature rotation can be determined. For example, referring to FIG. 6, if the current through the armature measured at 800 amps and the voltage across it is measured at 610 volts, it can then be determined that the armature is rotating at 800 RPM. From there, the formula to calculate locomotive speed in MPH is as follows:

$$800\frac{TMrev}{\text{Minute}} * 15\frac{wheelrev}{62TMrev} * \frac{Pi * \text{Diameter(inches)}}{wheelrev} * 60\frac{\text{min}}{\text{hour}} * \frac{\text{mile}}{63{,}360\ \text{inches}}$$

Thus, if it were determined that the traction motor armature was rotating at 800 RPM with the above wheels and gear ratio, it could quickly be determined that the locomotive's velocity would be 23.0 MPH.

It will be appreciated that any module or component exemplified herein that executes instructions may include or otherwise have access to computer readable media such as storage media, computer storage media, or data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media may be part of the locomotive control system 12 (or other computing or control device that utilizes similar principles) or accessible or connectable thereto. Any application or module herein described may be implemented using computer readable/executable instructions that may be stored or otherwise held by such computer readable media.

Figure 7:
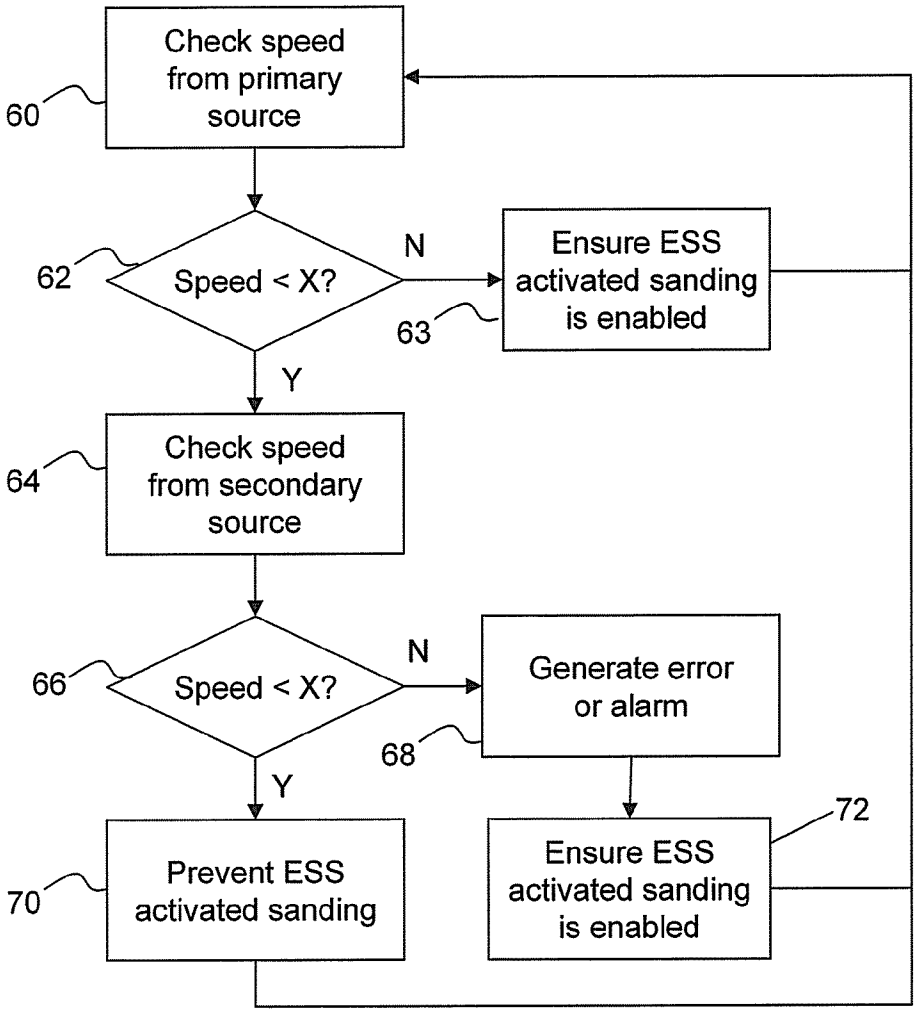
FIG. 7 is a flow chart illustrating example computer executable instructions for utilizing a secondary speed measurement for determining whether or not to disable a sanding system on the basis of a primary speed measurement.

Turning now to FIG. 7, the portion of the sanding control logic 53 for utilizing the secondary speed source 16 is shown.

At 60, the speed as provided by the primary speed source 14, e.g. the axle sensors 32, is checked by the locomotive control system 12. For example the processor 50 may be instructed to obtain a current speed measurement provided by the axle speed sensor module 54. The locomotive control system 12 then compares the primary speed measurement (e.g. axle speed) to a setpoint X at 62. In this example, the comparison is made to determine if the current axle speed is less than X (e.g. 1 mph). If the primary speed measurement is greater than X, this indicates that the locomotive is moving and thus normal sanding system 10 control should resume. As such, at 63, the locomotive control system 12 then ensures that sanding activated by the ESS is enabled. If the primary speed measurement is less than X, this should indicate that the locomotive is not moving and that sanding activated by the ESS should be prevented. However, as noted above, to avoid circumstances wherein ESS sanding is disabled erroneously, e.g. due to axle sensor failure, the secondary speed source 16 is checked at 64. For example, the processor 50 may be instructed to obtain a current speed measurement as provided by the GPS speed module 55 or the TM current and voltage module 56 as described above. The locomotive control system 12 then compares the secondary speed measurement to the same setpoint X at 66. If the secondary speed measurement is greater than X, this indicates a possible error related to the primary speed source 14, e.g. axle sensor failure and thus an error or alarm is generated at 68.Also, to ensure that the normal sanding system 10 control continues, the locomotive control system 12 ensures that sanding activated by the ESS is enabled at 72.

It can be appreciated that when the secondary speed measurement is higher than the setpoint X while the primary speed measurement is lower than the setpoint X, rather than preventing ESS activated sanding, which can cause the aforementioned cost and inconveniences, the sanding system 10 would be left to operate normally. By reporting the error at 68, the potential failure in the primary speed source 14 can be investigated at a more convenient time and in the meantime, the locomotive control system 12 can ensure that ESS activated sanding is enabled.

If the secondary speed measurement is less than the setpoint X at 66, this indicates that the primary speed measurement is correct as a trigger for having ESS activated sanding prevented, and such prevention is performed at 70 and operation continues at 60.

It has also been recognized that when using current and voltage measurements to determine the secondary speed measurement, the accuracy of such measurements may depend on whether or not the locomotive 10 is in power. For example, if the locomotive is coasting and the TMs 34 are not powered, the secondary speed source 16 may not be active. In such cases, it has been found that one can identify the axle generator as being healthy or unhealthy based on the last reading taken when the locomotive was in power and trigger an alarm if a problem is identified.

Figure 8:
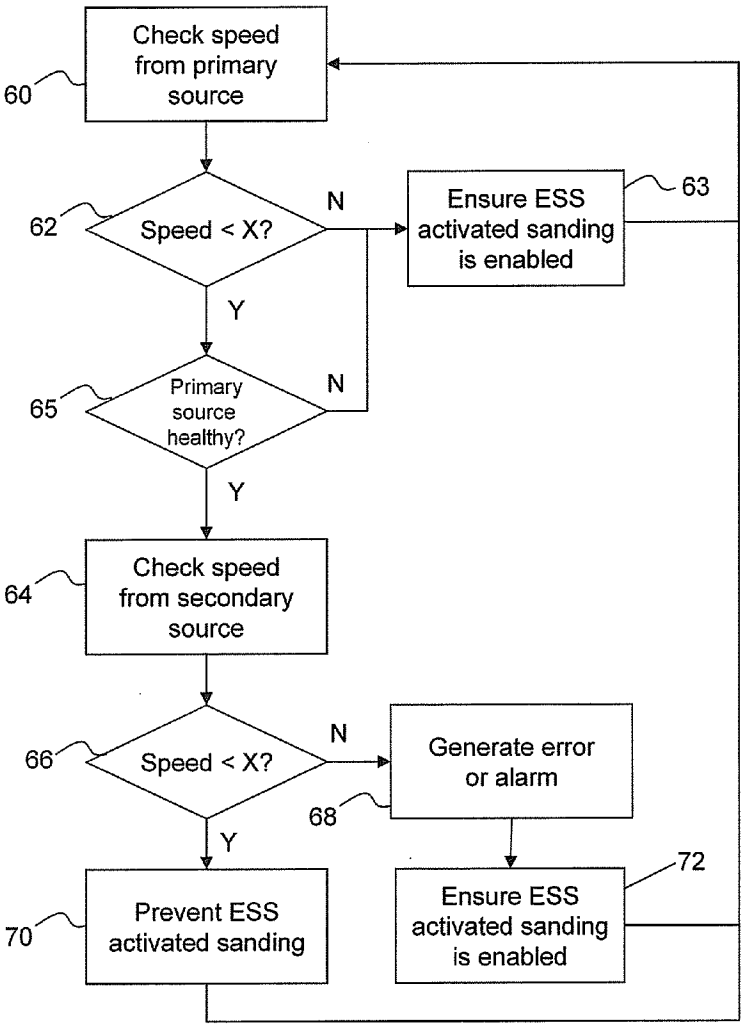
FIG. 8 is a flow chart illustrating example computer executable instructions for utilizing a secondary speed measurement for determining whether or not to disable a sanding system on the basis of a primary speed measurement including determining if the secondary speed source is healthy.

FIG. 8 illustrates the portion of the sanding control logic 53 for utilizing the secondary speed source 16, which is similar to that shown in FIG. 7 but also includes a decision at 65 to determine whether or not the primary speed source 14 is healthy. As shown in FIG. 8, if the primary speed source 14 is not healthy, the locomotive control system 12 then ensures that sanding activated by the ESS is enabled at 63. If the primary speed source 14 is healthy, the speed from the secondary source 16 may be checked at 64 as described above.

Figure 9:
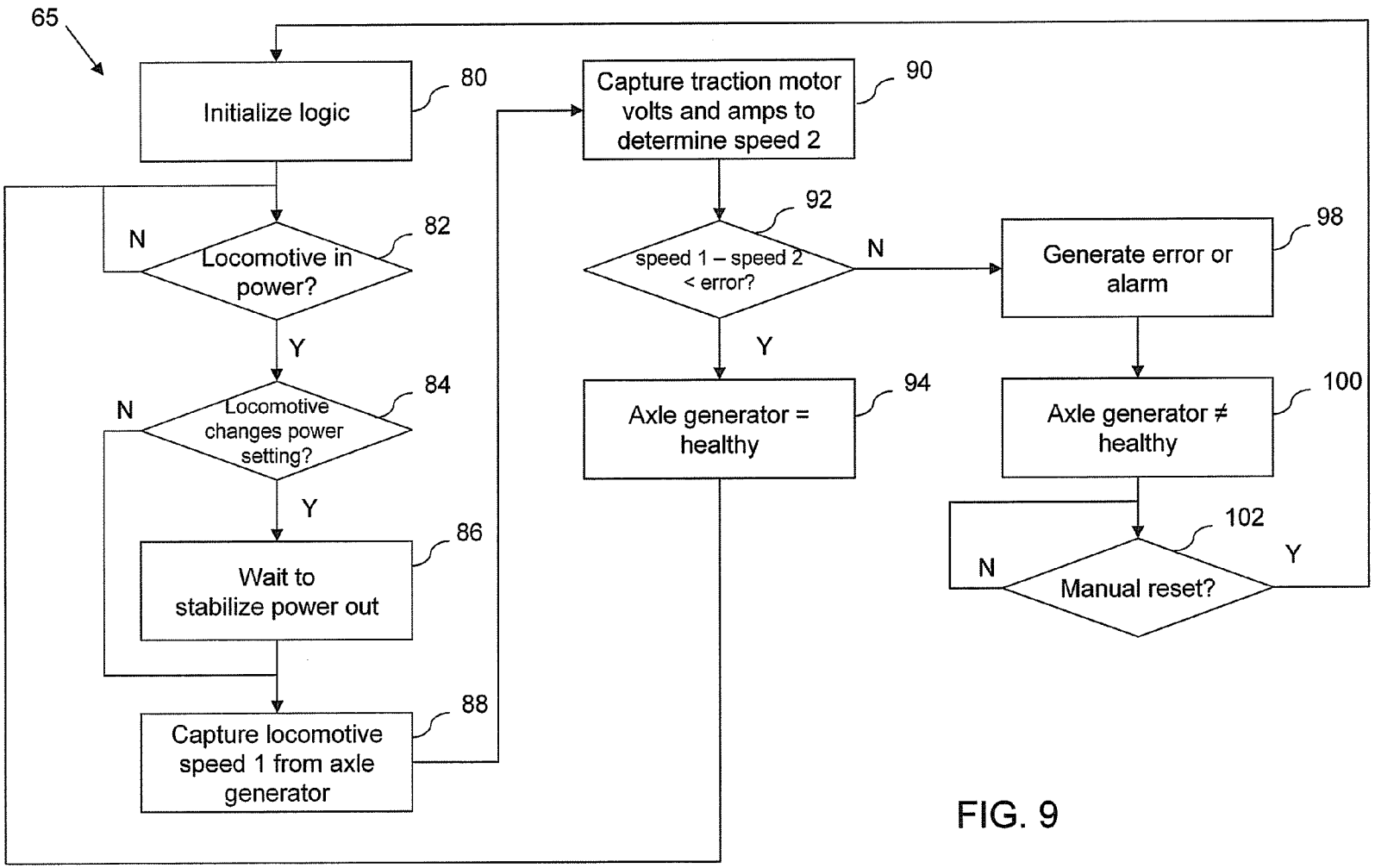
FIG. 9 is a flow chart illustrating example computer executable instructions for determining if the secondary speed source is healthy.

FIG. 9 illustrates example operations that may be performed in determining at 65 whether or not the primary speed source 14 is healthy. The logic performed at 65 is initialized at 80 and the locomotive control system 12 determines at 82 whether or not the locomotive 10 is in power. If not, the locomotive control system 12 repeats this determination at 82. If the locomotive 10 is in power, the locomotive control system 12 determines at 84 whether or not the locomotive 10 has changed its power setting (e.g. a throttle position has been changed). If the locomotive 10 has changed its power setting, the locomotive control system 12 waits a predetermined amount of time (e.g., 5 seconds) at 86 to stabilize the power output to be consistent with the power setting. If the locomotive 10 has not changed its power setting, or after waiting to stabilize the power output, the locomotive control system 12 captures or otherwise determines a first speed (speed 1) from the axle generator at 88, and captures or otherwise determines a second speed (speed 2) at 90 using the traction motor volts and amps (i.e. determines both the primary and secondary speeds). The locomotive control system 12 determines at 92 if the difference between speed 1 and speed 2 is less than an error threshold, e.g. 2 or 3 mph. If the difference is less than the error threshold, the locomotive control system 12 determines at 94 that the axle generator is healthy and then determines at 96 whether or not the locomotive 10 is in power. If not, the process proceeds to 82. If the locomotive 10 is in power, the process proceeds to 84.

If the difference between speed 1 and speed 2 is greater than the error threshold, an error or alarm (or both) is generated at 98 and locomotive control system 12 determines at 100 that the axle generator is not healthy. The locomotive control system 12 then determines at 102 whether or not a manual reset, in response to the error or alarm, has occurred. If not, the determination at 102 repeats. If a manual reset has occurred, the logic is again initialized at 80. The locomotive control system 12 obtained a determination of whether the axle generator is healthy or not for block 65 (FIG. 8) by referencing a setting or other indication provided in accordance with blocks 94 and 100. As such, the processes shown in FIGS. 8 and 9 may run independently with block 65 relying on an indication of axle generator healthy by performing the operations in FIG. 9.

It can be appreciated that although the examples shown herein compute the secondary speed measurement using GPS data or voltage and current measurements from the traction motors 34, any other suitable secondary speed source 16 can be used, such as speed sensors embedded in each traction motor for the purposes of controlling wheel slip.

Although the above principles have been described with reference to certain specific embodiments, various modifications thereof will be apparent to those skilled in the art without departing from the scope of the claims appended hereto.

The invention claimed is:

1. A method for controlling a locomotive performed by a processor of a locomotive control system, the method comprising:

the processor determining a first speed measurement for the locomotive from a primary speed source;

the processor determining a second speed measurement for the locomotive from a secondary speed source when the first speed measurement is below a setpoint;

the processor providing an instruction to prevent the activation of sanding on the locomotive when the second speed measurement is also below the setpoint; and the processor not preventing the activation of sanding on the locomotive when the second speed measurement is higher than the setpoint.

2. The method according to claim 1, further comprising the processor initiating at least one of reporting an error and providing an alarm when the second speed measurement is higher than the setpoint.

3. The method according to claim 1, further comprising the processor ensuring that an emergency sanding switch is enabled when the second speed measurement is higher than the setpoint.

4. The method according to claim 1, further comprising the processor ensuring that an emergency sanding switch is enabled when the primary speed measurement is higher than the setpoint.

5. The method according to claim 1, wherein the second speed measurement is provided by a global positioning system (GPS) receiver.

6. The method according to claim 1, wherein the second speed measurement is determined using current and voltage measurements obtained using traction motors on the locomotive.

7. The method according to claim 6, further comprising the processor determining whether or not the primary speed source is operational prior to determining the second speed measurement when the first speed measurement is lower than the setpoint.

8. The method according to claim 7, wherein determining whether or not the primary speed source is operational uses a previous speed measurement from the primary speed source while the locomotive was in power and comparing the previous speed measurement to the second speed measurement.

9. A non-transitory computer readable medium comprising computer executable instructions performed by a processor for controlling a locomotive, the computer executable instructions comprising instructions for:

determining a first speed measurement for the locomotive from a primary speed source;

determining a second speed measurement for the locomotive from a secondary speed source when the first speed measurement is below a setpoint;

providing an instruction to prevent the activation of sanding on the locomotive when the second speed measurement is also below the setpoint; and the processor not preventing the activation of sanding on the locomotive when the second speed measurement is higher than the setpoint.

10. The computer readable medium according to claim 9, further comprising instructions for initiating at least one of reporting an error and providing an alarm when the second speed measurement is higher than the setpoint.

11. The computer readable medium according to claim 9, further comprising instructions for ensuring that an emergency sanding switch is enabled when the second speed measurement is higher than the setpoint.

12. The computer readable medium according to claim 9, further comprising instructions for ensuring that an emergency sanding switch is enabled when the primary speed measurement is higher than the setpoint.

13. The computer readable medium according to claim 9, wherein the second speed measurement is provided by a global positioning system (GPS) receiver.

14. The computer readable medium according to claim 9, wherein the second speed measurement is determined using current and voltage measurements obtained using traction motors on the locomotive.

15. The computer readable medium according to claim 14, further comprising instructions for determining whether or not the primary speed source is operational prior to determining the second speed measurement when the first speed measurement is lower than the setpoint.

16. The computer readable medium according to claim 15 wherein determining whether or not the primary speed source is operational uses a previous speed measurement from the primary speed source while the locomotive was in power and comparing the previous speed measurement to the second speed measurement.

17. A locomotive control system for controlling a locomotive, the system comprising:

a processor and memory, the memory storing computer executable instructions that when executed by the processor operate the locomotive control system by:

determining a first speed measurement for the locomotive from a primary speed source;

determining a second speed measurement for the locomotive from a secondary speed source when the first speed measurement is below a setpoint;

providing an instruction to prevent the activation of sanding on the locomotive when the second speed measurement is also below the setpoint; and the processor not preventing the activation of sanding on the locomotive when the second speed measurement is higher than the setpoint.

18. The locomotive control system according to claim 17, further comprising instructions for initiating at least one of reporting an error and providing an alarm when the second speed measurement is higher than the setpoint.

19. The locomotive control system according to claim 17, further comprising instructions for ensuring that an emergency sanding switch is enabled when the second speed measurement is higher than the setpoint.

20. The locomotive control system according to claim 17, further comprising instructions for ensuring that an emergency sanding switch is enabled when the primary speed measurement is higher than the setpoint.

21. The locomotive control system according to claim 17, wherein the second speed measurement is provided by a global positioning system (GPS) receiver.

22. The locomotive control system according to claim 17, wherein the second speed measurement is determined using current and voltage measurements obtained using traction motors on the locomotive.

23. The locomotive control system according to claim 22, further comprising instructions for determining whether or not the primary speed source is operational prior to determining the second speed measurement when the first speed measurement is lower than the setpoint.

24. The locomotive control system according to claim 23, wherein determining whether or not the primary speed source is operational uses a previous speed measurement from the primary speed source while the locomotive was in power and comparing the previous speed measurement to the second speed measurement.

* * * * *